US008594342B2

(12) United States Patent
Martin et al.

(10) Patent No.: US 8,594,342 B2
(45) Date of Patent: Nov. 26, 2013

(54) TRANSDUCER DEVICE INCLUDING FEEDBACK CIRCUIT

(75) Inventors: Steven Martin, Fort Collins, CO (US); Osvaldo Buccafusca, Fort Collins, CO (US)

(73) Assignee: Avago Technologies General IP (Singapore) Pte. Ltd., Singapore (SG)

( * ) Notice: Subject to any disclaimer, the term of this patent is extended or adjusted under 35 U.S.C. 154(b) by 1152 days.

(21) Appl. No.: 12/402,600

(22) Filed: Mar. 12, 2009

(65) Prior Publication Data

US 2010/0232623 A1 Sep. 16, 2010

(51) Int. Cl.
*H04R 3/00* (2006.01)

(52) U.S. Cl.
USPC ..... 381/96

(58) Field of Classification Search
USPC ..... 381/151
See application file for complete search history.

(56) References Cited

U.S. PATENT DOCUMENTS

| | | | | |
|---|---|---|---|---|
| 4,109,107 | A | | 8/1978 | Boast |
| 4,288,765 | A | | 9/1981 | Mikoshiba et al. |
| 4,430,897 | A | * | 2/1984 | Quate ..... 73/606 |
| 5,649,020 | A | * | 7/1997 | McClurg et al. ..... 381/151 |
| 5,815,585 | A | | 9/1998 | Klippel |
| 6,282,298 | B1 | | 8/2001 | Azima et al. |
| 7,184,556 | B1 | | 2/2007 | Johnson et al. |
| 7,359,519 | B2 | | 4/2008 | Lee et al. |

OTHER PUBLICATIONS

Baborowski et al. "PZT Coated Membrane Structures for Micromachined Ultrasonic Transducers", Proceedings of the 13th IEEE International Symposium on Applications of Ferroelectrics, May 28-Jun. 1, 2002, pp. 483-486.

* cited by examiner

*Primary Examiner* — Steven Loke
*Assistant Examiner* — Jonathan Han

(57) ABSTRACT

A transducer device includes an acoustic transducer, a parameter extractor and a feedback circuit. The parameter extractor is configured to extract an operating parameter from the acoustic transducer. The feedback circuit is configured to generate a correction signal based on a difference between the extracted operating parameter and a corresponding reference parameter. The correction signal is applied to adjust the operating parameter of the acoustic transducer.

20 Claims, 10 Drawing Sheets

TRANSDUCER DEVICE INCLUDING FEEDBACK CIRCUIT

BACKGROUND

Generally, acoustic transducers convert received electrical signals to acoustic signals when operating in a transmit mode, and/or convert received acoustic signals to electrical signals when operating in a receive mode. The functional relationship between the electrical and acoustic signals of an acoustic transducer depends, in part, on the acoustic transducer's operating parameters, such as natural or resonant frequency, acoustic receive sensitivity, acoustic transmit output power and the like.

Acoustic transducers are manufactured pursuant to specifications that provide specific criteria for the various operating parameters. Applications relying on acoustic transducers, such as piezoelectric ultrasonic transducers and electro-mechanical system (MEMS) transducers, for example, typically require precise conformance with these criteria. Depending on variations in the fabrication process and stringency of the specifications, usable yield of acoustic transducers may be relatively small since the operating parameters are not adjustable in the finished product. Additionally, during normal use and even storage of acoustic transducers, the operating parameters may shift, for example, due to aging, temperature and humidity variations, and applied signals, resulting in unacceptable divergence from the criteria provided by the specifications.

BRIEF DESCRIPTION OF THE DRAWINGS

The example embodiments are best understood from the following detailed description when read with the accompanying drawing figures. It is emphasized that the various features are not necessarily drawn to scale. In fact, the dimensions may be arbitrarily increased or decreased for clarity of discussion. Wherever applicable and practical, like reference numerals refer to like elements.

DETAILED DESCRIPTION

In the following detailed description, for purposes of explanation and not limitation, representative embodiments disclosing specific details are set forth in order to provide a thorough understanding of the present teachings. However, it will be apparent to one having ordinary skill in the art having had the benefit of the present disclosure that other embodiments according to the present teachings that depart from the specific details disclosed herein remain within the scope of the appended claims. Moreover, descriptions of well-known apparatuses and methods may be omitted so as to not obscure the description of the representative embodiments. Such methods and apparatuses are clearly within the scope of the present teachings.

Generally, according to various embodiments, an operational acoustic transducer receives feedback, continuously or periodically, indicating values of operating parameters, such as natural or resonant frequency. In response, adjustments may be made to either the acoustic transducer itself (e.g., adjusting the resonant frequency) or to an excitation signal input to the acoustic transducer (e.g., adjusting the frequency of the input acoustic or electrical signal). Accordingly, the operating parameters may be maintained at specified or desired values, e.g., to account for variations due to age, temperature, manufacturing variance, usage and the like, or the operating parameters may be flexibly adjusted to meet operating criteria.

In accordance with the various embodiments, the ability to adaptively vary operating parameters of acoustic transducers may increase manufacturing yield, since operating parameters of the acoustic transducers which would otherwise fail initial testing can be corrected. Further, adaptive control of operating parameters can be applied to acoustic transducers in the field to counteract environmental effects, such as aging, temperature and humidity variation, and the like, to provide consistent performance throughout the operational lifetime of the acoustic transducers, and to extend the usable lifetime. Additionally, the application or end user may desire reports or diagnostics on real-time transducer parameters. Various embodiments would enable such real-time data extraction.

Figure 1:
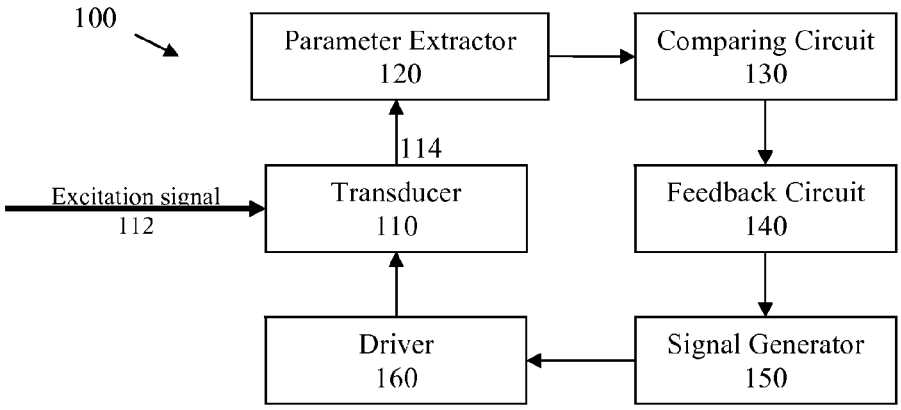
FIG. 1 is a functional block diagram of a transducer device, according to a representative embodiment.

FIG. 1 is a functional block diagram of a transducer device, according to a representative embodiment, in which feedback directly adjusts an operating parameter of the transducer, such as the resonant frequency.

Referring to FIG. 1, transducer device 100 includes transducer 110 configured to receive excitation signal 112 and provide acoustic transducer response 114. In an embodiment, the transducer 110 is an acoustic transducer, such as a piezoelectric ultrasonic transducer, capable of operating in transmit and/or receive modes. When operating in the transmit mode, the excitation signal 112 is an electrical signal received by the transducer 110, which outputs a corresponding acoustic signal according to a predetermined function as the acoustic transducer response 114. The acoustic transducer response 114 is generated by mechanical vibrations of the transducer 110 induced by the received electrical excitation signal 112. When operating in the receive mode, the excitation signal 112 is an acoustic signal received by the transducer 110, which outputs a corresponding electronic signal as the acoustic transducer response 114.

The transducer device 100 also includes parameter extractor 120, comparing circuit 130, feedback circuit 140 and signal generator 150. The parameter extractor 120 receives the acoustic transducer response 114 from the transducer 110, and extracts or measures at least one predetermined operating parameter (e.g., indicative of performance characteristics of the transducer 110), on which the feedback decision is to be based. In an embodiment, the parameter extractor 120 extracts the center frequency of the acoustic transducer response 114, which indicates the resonant frequency of the transducer 110. In various alternative embodiments, the parameter extractor 120 does not receive the acoustic transducer response 114, but rather receives an electrical signal, which is a function of the acoustic transducer response 114, dedicated to operation of the feedback loop. For example, when operating in the transmit mode, the parameter extractor 120 may receive an induced electrical signal representative of the acoustic transducer response 114, as opposed to the acoustic transducer response 114, itself. For purposes of simplifying explanation, acoustic transducer response 114 is intended to include such induced electrical signals, as well, unless otherwise specified.

The comparing circuit 130 compares the extracted parameter to a corresponding desired parameter, e.g., provided by specification, and determines the difference, if any. The feedback circuit 140 determines a feedback response defining a feedback signal required to eliminate the difference determined to exist between the extracted parameter and the desired parameter. In an embodiment, the feedback response identifies magnitude and sign (e.g., phase) of the feedback signal, which when applied will cause the parameter of the transducer 110, corresponding to the extracted parameter, to match or to more closely approximate the desired parameter.

The signal generator 150 then generates the feedback signal, based on the feedback response provided by the feedback circuit 140. For example, the signal generator 150 may be a digital-to-analog converter (DAC), which converts the digital feedback response from the feedback circuit 140 to an analog feedback signal, such as a DC bias voltage. In an embodiment, the feedback signal is filtered by a filter (not shown), for example, to reduce unwanted oscillatory behavior or to further enhance the transient nature of the feedback control system. Also, in an embodiment, the transducer device 100 may include driver 160, for converting the feedback signal to useful form prior to being applied to the transducer 110. For example, the driver 160 may be an amplifier, which amplifies the DC voltage from the signal generator 150 to provide a DC bias voltage of desired magnitude. The DC bias voltage (or other type feedback signal) is then applied to the transducer 110 in order to change the extracted parameter, e.g., to match the desired parameter provided by specification. The feedback signal may be applied in a positive (regenerative) or a negative (degenerative) manner.

Figure 2:
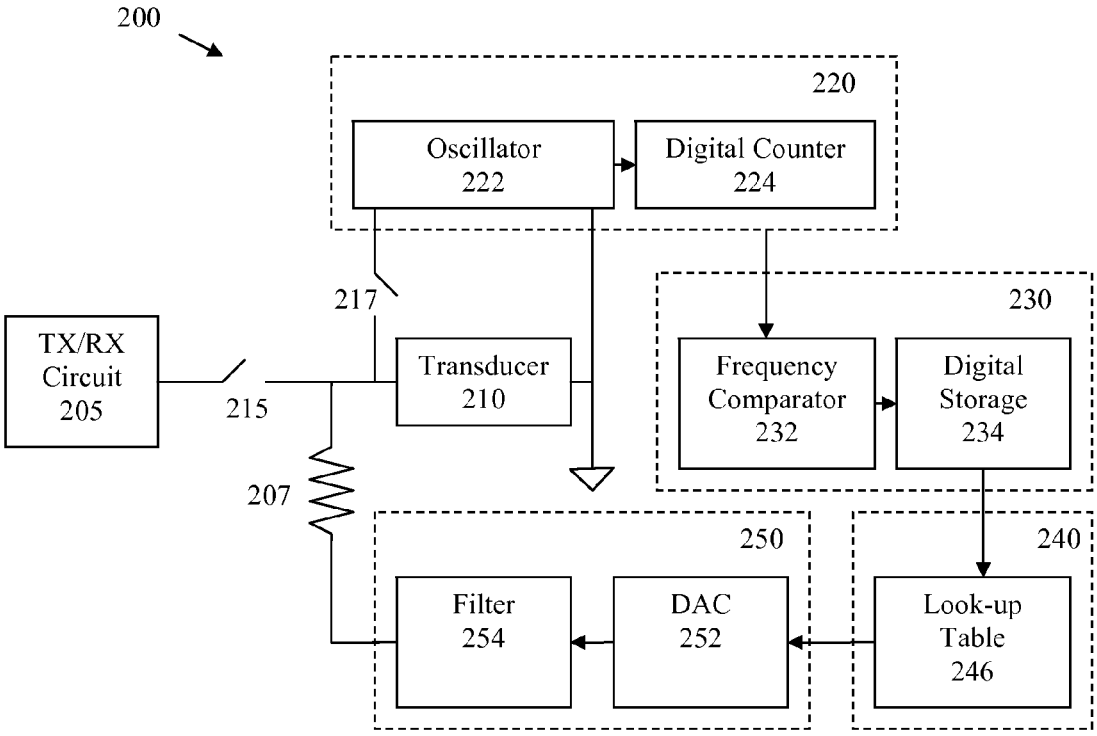
FIG. 2 is a functional block diagram of a transducer device, according to a representative embodiment.

FIG. 2 is a functional block diagram of a transducer device, according to a representative embodiment.

Referring to FIG. 2, transducer device 200 is an example of a configuration in which a feedback signal is directly applied to transducer 210 to adjust a transducer parameter, as described generally with reference to FIG. 1. In particular, the transducer device 200 depicts a representative feedback loop that directly adjusts frequency and/or phase of the resonant frequency of the transducer 210, which may change with aging of the transducer 210, temperature, humidity and other environmental factors. The transducer device 200 further includes parameter extractor 220, comparing circuit 230, feedback circuit 240 and signal generator 250. It is understood that the transducer device 200 and/or the signal generator 250 may include a driver (not shown), as discussed above with respect to driver 160 in FIG. 1, as needed.

In the depicted embodiment, the parameter extractor 220 includes oscillator 222 and digital counter 224 in order to determine the resonant frequency of the calibration transducer 210. It is understood that in alternative embodiments, parameters other than resonant frequency of the transducer 210, such as acoustic receive sensitivity, acoustic transmit output power and relative bandwidth, may be monitored and adjusted, as needed, to alter performance of the transducer 210, without departing from the scope of the disclosure. For example, applying a DC bias voltage to the transducer 210 (via the signal generator 250, discussed below) changes stiffness of the transducer 210, which correspondingly alters the receive sensitivity.

The transducer 210 is selectively connected to the oscillator 222 through operation of switch 217, in order to periodically extract (or measure) the resonant frequency of the transducer 210. In an embodiment, the transducer 210 is selectively disconnected from the transmit/receive circuit 205 through operation of switch 215 when the transducer 210 is connected to the oscillator 222. In an alternative embodiment, the transducer 210 is always connected to the oscillator 222 for continuous parameter extraction. The digital counter 224 connected to an output of the oscillator 222 determines the resonant frequency of the transducer 210 whenever the transducer 210 is connected to the oscillator 222.

The comparing circuit 230 receives data identifying the extracted resonant frequency, as determined by the digital counter 224. The comparing circuit 230 includes frequency comparator 232 and digital storage 234. The frequency comparator 232 compares the extracted resonant frequency data to a reference digital count, which identifies the desired resonant frequency (e.g., the resonant frequency required by specification or the original resonant frequency of the transducer 210, which may be the same frequency). Based on the comparison, the frequency comparator 232 outputs a difference signal, which may be a digital code word, for example. The digital code word is stored in digital storage 234. In various embodiments, the digital storage 234 may part of the comparing circuit 230, or the digital storage 234 may be a memory separate from the comparing circuit 230 and/or the transducer device 200. For example, the digital storage 234 may be implemented as RAM, buffers, latches or any other type memory device. Also, the digital storage 234 is not limited to storing digital code words and may, for example, store data identifying the extracted resonant frequency, previously extracted resonant frequencies, temperature, operation time, receive sensitivity, transmit output power, bandwidth and other parameters. The stored data identifying the extracted resonant frequency, in particular, may also be sent to a system controller (not shown), which reports current operating parameters to other system functions or the end user, e.g., for diagnostic or reporting purposes.

The feedback circuit 240 retrieves the digital code word from the digital storage 234, and determines a correction voltage corresponding to the digital code word using look-up table 246. The correction voltage is a DC bias voltage that is to be supplied to the transducer 210 to account for any change in the resonant frequency. The look-up table 246 may be included in a relational database, for example. In an embodiment, the look-up table 246 relates correction voltages and frequency differences as a function of DC bias voltages and resonant frequencies specific to the transducer 210. The feedback circuit 240 is thus able to determine the correction voltage to be applied to the transducer 210 (via the signal generator 250) in order to for the transducer 210 to produce a corrected resonant frequency.

Alternatively, the feedback circuit 240 may receive the digital code word directly from the frequency comparator 232. Also, in alternative embodiments, the feedback circuit 240 may include a processor (not shown), e.g., as discussed below with respect to processor 446 of FIG. 4, instead of the look-up table 246. The processor provides greater flexibility and adaptive control over feedback algorithms. For example, with a processor, the feedback circuit 240 may simply receive data identifying the extracted resonant frequency from the digital counter 224 and compute the frequency difference prior to determining the correction voltage, and may also factor in additional parameters and information, such as temperature, resonant frequency trends and the like, in determining the correction voltage. Also, in another embodiment, the parameter extractor 220 may include a frequency-to-voltage converter (not shown), which samples and stores voltages corresponding to the resonant frequency of the transducer 210. The feedback circuit 240 may then determine the correction voltage as a function of the stored voltages or digital code words corresponding to the stored voltages.

Figure 3A:
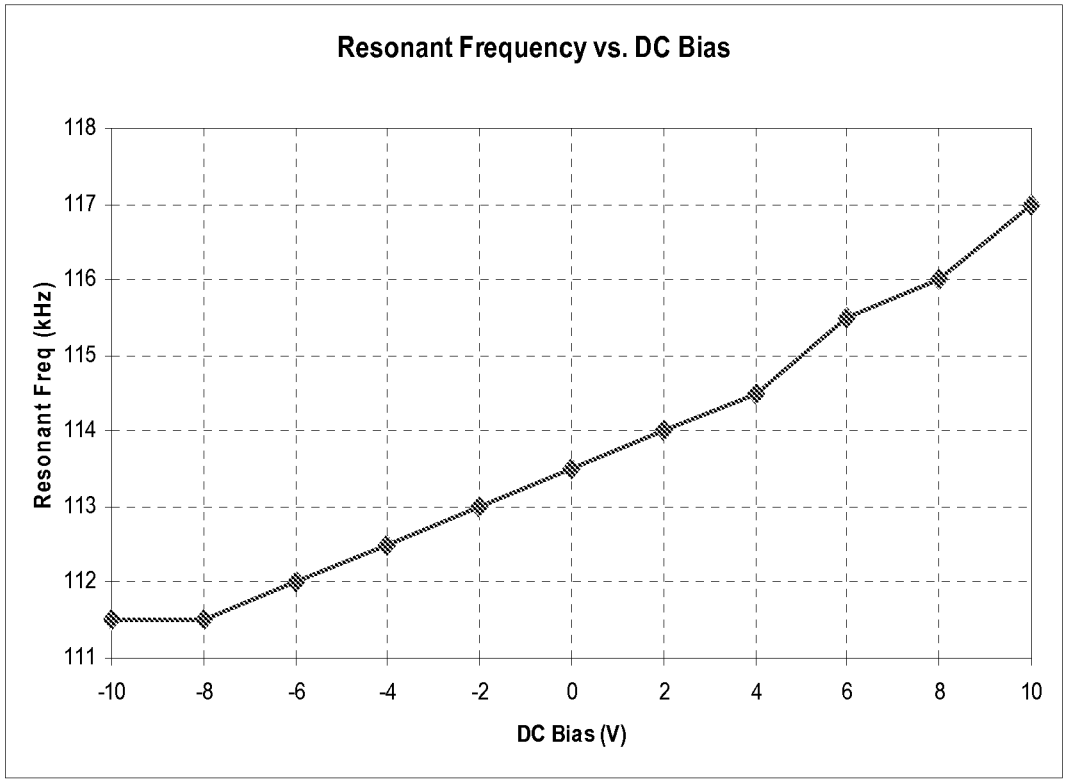
FIG. 3*a* is a graph showing a representative relationship between resonant frequency and bias voltage of a transducer device, according to a representative embodiment.

FIG. 3*a* is a graph of a representative relationship between DC bias voltages (e.g., in volts) and resonant frequencies (e.g., in kHz) for transducer 210. The look-up table 246 may be based on the representative relationship in order to select a correction voltage to adjust the resonant frequency of the transducer 210. For example, it is assumed for purposes of discussion that the desired resonant frequency of the transducer 210 is 116 kHz, and that the extracted resonant frequency (determined by digital counter 224) is 115 kHz. Thus, the frequency comparator 232 determines that the difference between the desired and extracted frequencies is negative 1 kHz. Referring to FIG. 3, it can be determined that the desired resonant frequency of 116 kHz is obtained by an 8V DC bias voltage, and that the extracted resonant frequency of 115 kHz is obtained by a 5V DC bias voltage. Therefore, in this example, the look-up table 246 relates a negative 1 kHz frequency difference with a positive 3V DC bias voltage, which when supplied to the transducer 210 would increase the resonant frequency by 1 kHz, compensating for the measured reduction in the resonant frequency.

The signal generator 250 receives a digital signal from the feedback circuit 240 identifying the correction voltage to be supplied to the transducer 210. In an embodiment, the signal generator 250 includes a DAC 252 and an analog filter 254. The DAC 252 generates a DC correction voltage, which is filtered by analog filter 254 and provided to the transducer 210 through resistor 207. Therefore, the transducer 210 receives the DC correction voltage along with a constant frequency input signal (electronic or acoustic) from the transmit/receive circuit 205, and accordingly outputs a constant frequency output signal (acoustic or electric, respectively) based on the desired resonant frequency. It is understood that the functionally of the DAC 252 may have a variety of implementations in addition to a DAC, such as a variable DC regulator, a pulse width modulator (PWM) circuit, a variable DC voltage divider, and the like, without departing from the scope of the disclosure.

It will also be understood that, although functionally is segregated for explanation purposes, the various operations of the transducer device 200 may be physically implemented in any arrangement using software, hard-wired logic circuits, or a combination therefore. For example, the digital counter 224, the frequency comparator 232 and/or the look-up table 240 (or processor) may be included all or in part in a single software module.

Figure 4:
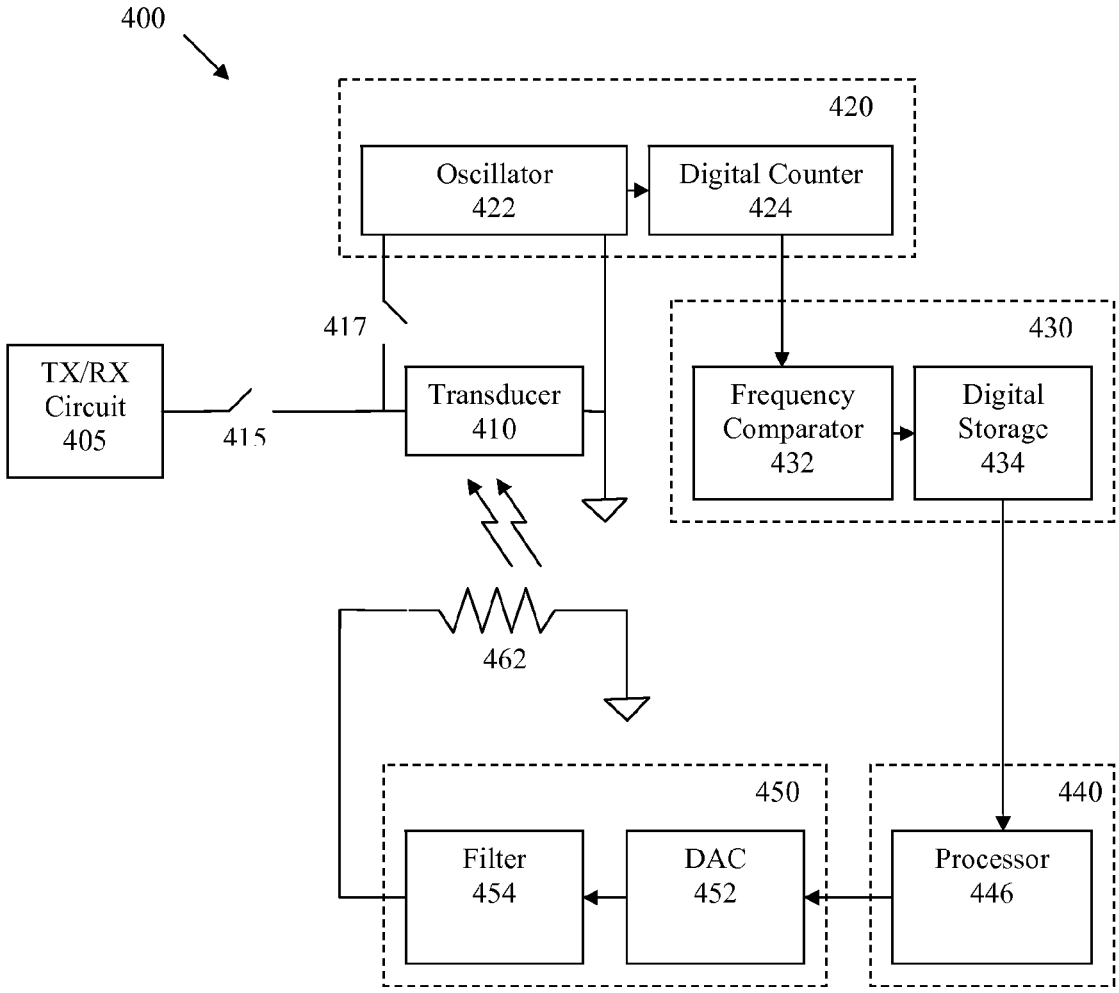
FIG. 4 is a functional block diagram of a transducer device, according to a representative embodiment.

FIG. 4 is a functional block diagram of a transducer device, according to a representative embodiment.

Referring to FIG. 4, transducer device 400 is another example of a configuration in which a feedback signal is directly applied to transducer 410 to adjust a transducer parameter, as described generally with reference to FIG. 1. In particular, the transducer device 400 depicts a representative feedback loop that directly adjusts frequency and/or phase of the resonant frequency of the transducer 410 by selectively heating the transducer 410 using heating element 462. This enables the transducer device 400 to correct for shifts in resonant frequency of the transducer 410 due to temperature and/or other causes. The transducer device 400 further includes parameter extractor 420, comparing circuit 430, feedback circuit 440 and signal generator 450. It is understood that the transducer device 400 and/or the signal generator 450 may include a driver (not shown), as discussed above with respect to driver 160 in FIG. 1, as needed.

In the depicted example, the heating element 462 is a resistive heater, such that varying voltage across a resistor included in the heating element 462 varies the temperature, although other types of variable heating elements may be included. For example, when the heating element 462 has a positive temperature coefficient, increasing the voltage (e.g., correction voltage, discussed below) increases the temperature of the heating element 462. In various embodiments, the heating element 462 may be included on the same substrate as the transducer 410, in the same package as the transducer 410 or in another system enclosed in the same housing as the transducer 410.

In the depicted embodiment, the parameter extractor 420 includes oscillator 422 and digital counter 424 in order to determine the resonant frequency of the transducer 410. It is understood that in alternative embodiments, parameters other than resonant frequency of the transducer 410, such as acoustic receive sensitivity, acoustic transmit output power and relative bandwidth, may be monitored and adjusted, as needed, to alter performance of the transducer 410, without departing from the scope of the disclosure.

The transducer 410 is selectively connected to the oscillator 422 through operation of switch 417, in order to periodically extract (or measure) the resonant frequency of the transducer 410. In an embodiment, the transducer 410 is selectively disconnected from the transmit/receive circuit 405 through operation of switch 415 when the transducer 410 is connected to the oscillator 422. In an alternative embodiment, the transducer 410 is always connected to the oscillator 422 for continuous parameter extraction. The digital counter 424 connected to an output of the oscillator 422 determines the resonant frequency of the transducer 410 whenever the transducer 410 is connected to the oscillator 422.

The comparing circuit 430 receives the extracted resonant frequency, as determined by the digital counter 424. The comparing circuit 430 includes frequency comparator 432 and digital storage 434, which function as discussed above with respect to frequency comparator 232 and digital counter 224 of FIG. 2. Based on the comparison, the frequency comparator 432 outputs a difference signal, which may be a digital code word, for example, which is stored in digital storage 434.

The feedback circuit 440 receives the digital code word from the digital storage 434 (or directly from the frequency comparator 432), and determines a correction voltage corresponding to the digital code word using processor 446. The processor 446 may be a software-controlled microprocessor, hard-wired logic circuits, or a combination thereof, configured to execute one or more software algorithms, including the operating parameter feedback control process of the embodiments described herein. The processor 446 may include an internal memory, including nonvolatile read only memory (ROM) and volatile RAM, for example, and executes the one or more software algorithms in conjunction with the internal memory and/or the digital storage 434. In addition, the data stored in digital storage 434 may be sent to a system controller (not shown), which reports current operating parameters to other system functions or the end user, e.g., for diagnostic or reporting purposes.

In an alternative embodiment, the feedback circuit 440 may include a look-up table, as discussed above with respect to look-up table 246 of FIG. 2, which relates correction voltages as a function of detected differences in resonant frequencies (e.g., indicated by the digital code word) specific to the transducer 410. However, as compared to a look-up table, the processor 446 provides more flexibility in interpreting the digital code word, determining the appropriate temperature differential of the transducer 410 to compensate for the difference between the desired resonant frequency and the extracted resonant frequency, and determining the amount by which the voltage across the heating element 462 must be adjusted in order to increase (or decrease) the temperature of the transducer 410 by the temperature differential.

In addition, the feedback algorithm executable by the processor 446 may include a proportional-integral-derivative (PID) control to prevent or suppress resonant frequency oscillations caused by the feedback. PID control may be incorporated into any embodiments described herein, although PID control is particularly useful for adjusting resonant frequency by adjusting temperature due to the relatively long time-lag between detecting the resonant frequency and increasing or decreasing the temperature of the transducer 410, e.g., by varying the resistance and/or correction voltage of the heating element 462.

In various embodiments, the functionality of the feedback circuit 440 and/or the processor 446 may be implemented in various forms without departing from the scope of the disclosure. For example, the transducer device 400 may incorporate a field-programmable gate array (FPGA), an application specific integrated circuit (ASIC), or a microcontroller, for example, to perform all or part of this functionality.

Figure 3B:
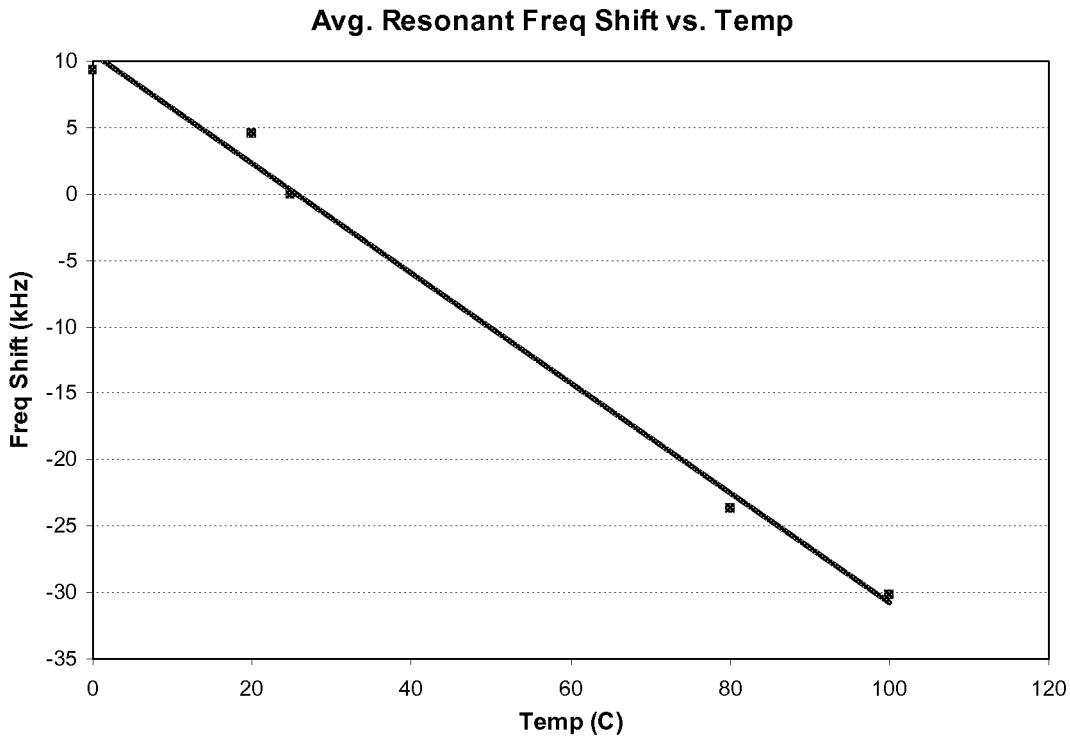
FIG. 3*b* is a graph showing a representative relationship between resonant frequency and temperature of a transducer device, according to a representative embodiment.

Accordingly, the feedback circuit 440 determines the correction voltage to be applied to the heating element 462, in order to appropriately adjust the temperature of the transducer 410. For example, FIG. 3*b* is a graph of a representative relationship between temperature (e.g., in Celsius) and shift in resonant frequencies (e.g., in kHz) for transducer 410. The processor 446 may utilize such a representative relationship in order to select a temperature and corresponding correction voltage to adjust the resonant frequency of the transducer 410.

The signal generator 450 receives a digital signal from the feedback circuit 440 indicating the correction voltage to be supplied to the heating element 462, in order to regulate the temperature of the transducer 410. In an embodiment, the signal generator 450 includes a DAC 452 and an analog filter 454. The DAC 452 generates a DC correction voltage, which is filtered by analog filter 454 and provided to the heating element 462. The heating element 462 adjusts its temperature based on the DC correction voltage, and heats the transducer 410 accordingly. In an embodiment, the transducer 410 normally operates at a temperature higher than ambient temperature (e.g., room temperature), so that the transducer 410 is able to decrease in temperature (e.g., by the heating element 462 providing a lower resistive heat), as well as to increase in temperature.

When the transducer 410 has a positive temperature coefficient, its resonant frequency increases with increased temperature, and when the transducer 410 has a negative temperature coefficient, its resonant frequency decreases with increased temperature. Accordingly, the transducer 410 outputs a constant frequency output signal (acoustic or electric) that matches the desired resonant frequency when it receives a constant frequency input signal (electronic or acoustic, respectively) from the transmit/receive circuit 405.

Figure 5:
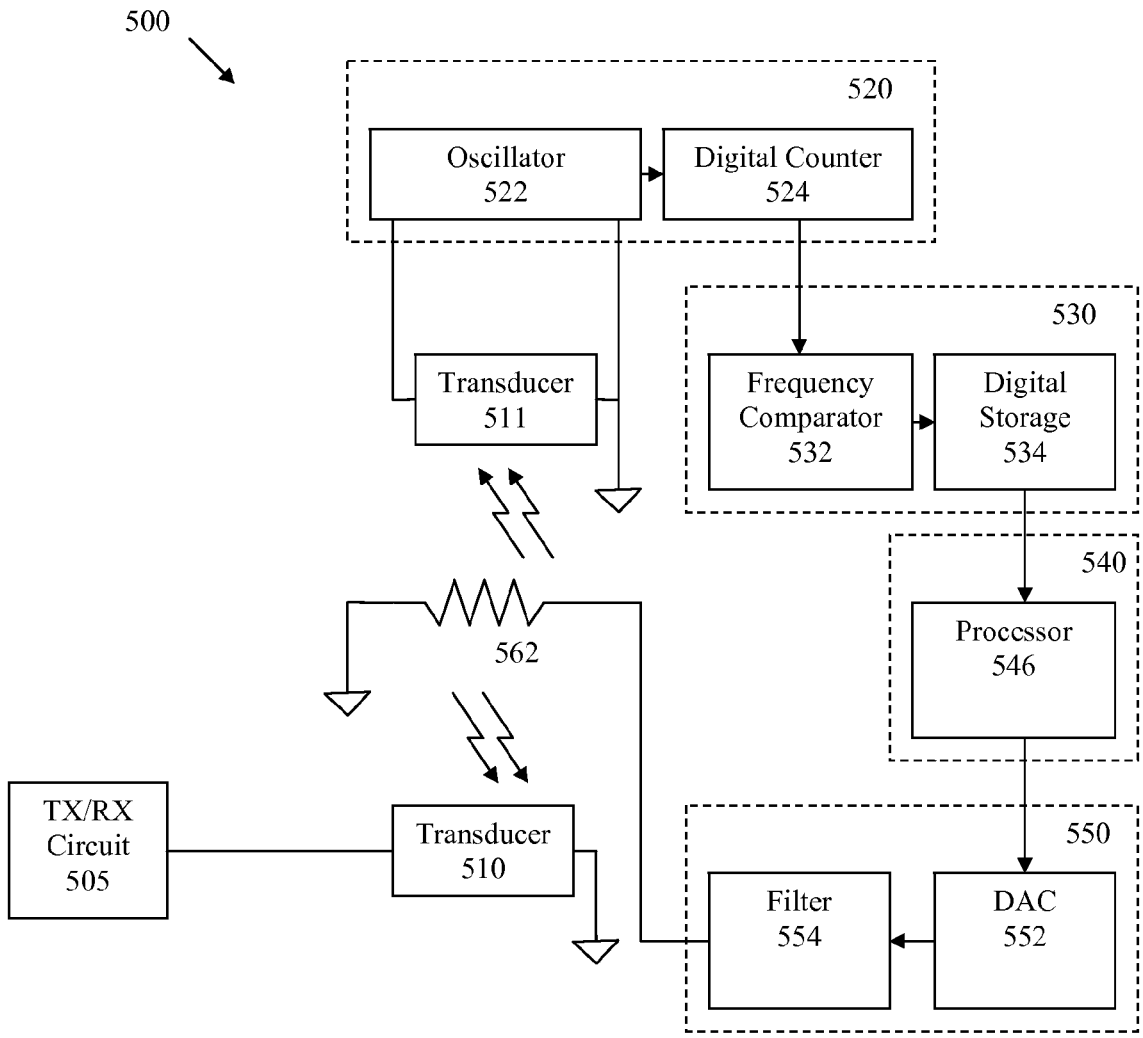
FIG. 5 is a functional block diagram of a transducer device, according to a representative embodiment.

FIG. 5 is a functional block diagram of a transducer device, according to a representative embodiment.

Referring to FIG. 5, transducer device 500 is another example of a configuration in which a feedback signal is directly applied to transducer 510 to adjust a transducer parameter, as described generally with reference to FIG. 1. Transducer device 500 is similar to transducer device 400 of FIG. 4 in that it includes a feedback loop that directly adjusts a resonant frequency of transducer 510 by selectively heating the transducer 510 using heating element 562. However, unlike transducer device 400, transducer device 500 includes a separate transducer, calibration transducer 511, which is dedicated to providing feedback for determining control of the resonant frequency of the transducer 510.

The effect of temperature (e.g., controlled by heating element 562) on resonant frequency of the calibration transducer 511 is the same as or proportional to the effect of temperature on the resonant frequency of the transducer 510. For example, the calibration transducer 511 may be identical to the transducer 510, thus having the same frequency response with respect to changes in temperature as the transducer 510. Alternatively, the calibration transducer 511 may have a known variation with respect to temperature and resonant frequency as the transducer 510, such that the effect of temperature changes on the resonant frequency of the calibration transducer 511 can be translated to the transducer 510. For example, the calibration transducer 511 and the transducer 510 may have the same temperature coefficient, or the known variation may be accounted for in a lookup table.

The transducer device 500 further includes parameter extractor 520, comparing circuit 530 and feedback circuit 540 in a feedback loop with the calibration transducer 511. In the depicted embodiment, the parameter extractor 520 includes oscillator 522 and digital counter 524 in order to determine the resonant frequency of the calibration transducer 511. It is understood that in alternative embodiments, parameters other than resonant frequency of the calibration transducer 511, such as acoustic receive sensitivity, acoustic transmit output power and relative bandwidth, may be monitored and adjusted, as needed, to alter performance of the calibration transducer 511 (and thus the transducer 510), without departing from the scope of the disclosure.

The transducer 510 is always connected to the oscillator 522 for continuous parameter extraction. In other words, since the calibration transducer 511 is separate from the transducer 510, there is no need for a switch to selectively connect the transducer 510 to implement the feedback loop. The calibration transducer 511 is dedicated to the feedback loop, enabling the transducer 510 to operate more efficiently and without interruption for parameter extraction and analysis. The digital counter 524 connected to an output of the oscillator 522 determines the resonant frequency of the calibration transducer 511.

The comparing circuit 530 receives data identifying the extracted resonant frequency, as determined by the digital counter 524 in order to compare the extracted resonant frequency with the desired resonant frequency. The comparing circuit 530 includes frequency comparator 532 and digital storage 534, which function as discussed above with respect to frequency comparator 232 and digital storage 234 of FIG. 2. Based on the comparison, the frequency comparator 532 outputs a difference signal, which may be a digital code word, for example, which is stored in digital storage 534.

The feedback circuit 540 receives the digital code word from the digital storage 534 (or directly from the frequency comparator 532), and determines a correction voltage corresponding to the digital code word using processor 546. The processor 546 may be a software-controlled microprocessor, hard-wired logic circuits, or a combination thereof, configured to execute one or more software algorithms, as discussed above with respect to processor 446, including the operating parameter feedback control process of the embodiments described herein. In an alternative embodiment, the feedback circuit 540 may include a look-up table, as discussed above with respect to look-up table 246 of FIG. 2, which relates correction voltages as a function of detected differences in resonant frequencies (e.g., indicated by the digital code word) specific to the calibration transducer 511. In addition, the data stored in digital storage 534 may be sent to a system controller (not shown), which reports current operating parameters to other system functions or the end user, e.g., for diagnostic or reporting purposes.

In various embodiments, the functionality of the feedback circuit 540 and/or the processor 546 may be implemented in various forms without departing from the scope of the disclosure. For example, the transducer device 500 may incorporate an FPGA, a custom ASIC, or a microcontroller, for example, to perform all or part of this functionality.

Accordingly, the feedback circuit 540 determines the correction voltage to be applied to the heating element 562, in order to appropriately adjust the temperature of the calibration transducer 511, as well as the transducer 510. The signal generator 550 receives a digital signal from the feedback circuit 540 indicating the correction voltage to be supplied to the heating element 562, in order to regulate the temperature of the transducers 510 and 511. In an embodiment, the signal generator 550 includes a DAC 552 and an analog filter 554. It is understood that the transducer device 500 and/or the signal generator 550 may also include a driver (not shown), as discussed above with respect to driver 160 in FIG. 1, as needed. The DAC 552 generates a DC correction voltage, which is filtered by analog filter 554 and provided to the heating element 562. The temperature of the heating element 562 adjusts in response to the DC correction voltage, and heats (or stops heating) the transducers 510 and 511, accordingly.

In the depicted example, the heating element 562 is a resistive heater, although other types of controllable heating elements may be included, as discussed above with respect to the heating element 462 of FIG. 4. Also, in an embodiment, the transducers 510 and 511 normally operate at a temperature higher than ambient temperature (e.g., room temperature), so that they are able to decrease in temperature (e.g., by the heating element 562 providing less resistive heat in response to a lower DC correction voltage), as well as to increase in temperature. Accordingly, the transducer 510 outputs a constant frequency output signal (acoustic or electric) that matches the desired resonant frequency when it receives a constant frequency input signal (electronic or acoustic, respectively) from the transmit/receive circuit 505.

In addition, it is understood that the representative configuration depicted in FIG. 5 may be similarly implemented using control parameters other than the temperature. For example, the representative configuration depicted in FIG. 5 may include a feedback system that controls DC bias voltage input to the transducer 510 (as discussed above with respect to FIG. 2) to adjust the resonant frequency of the transducer 510, where the amount of DC bias voltage is determined as a function of the resonant frequency extracted from the calibration transducer 511.

Figure 6:
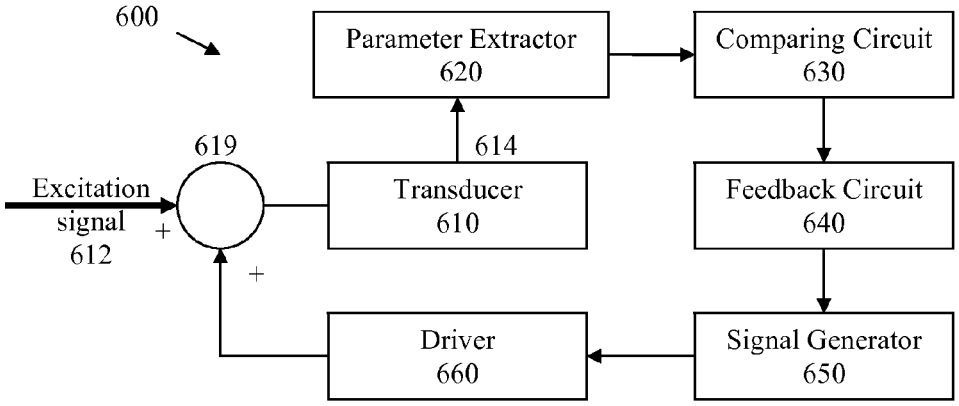
FIG. 6 is a functional block diagram of a transducer device, according to a representative embodiment.

FIG. 6 is a functional block diagram of a transducer device, according to a representative embodiment, in which feedback adjusts an excitation signal received by the transducer.

Referring to FIG. 6, transducer device 600 includes transducer 610 configured to receive excitation signal 612 and to provide transducer response 614. In an embodiment, the transducer 610 is an acoustic transducer, such as a piezoelectric ultrasonic transducer, capable of operating in transmit and/or receive modes, as discussed above with respect to transducer 110 of FIG. 1.

The transducer device 600 also includes parameter extractor 620, comparing circuit 630, feedback circuit 640 and signal generator 650. The parameter extractor 620 receives the transducer response 614 from the transducer 610, and extracts or measures a predetermined parameter(s) (e.g., indicative of performance characteristics of the transducer 610), on which the feedback decision is to be based. In an embodiment, the parameter extractor 620 extracts the center frequency of the transducer response 614, which indicates the natural or resonant frequency of the transducer 610.

The comparing circuit 630 compares the extracted parameter to a corresponding desired parameter, e.g., provided by specification, and determines the difference, if any. The feedback circuit 640 determines a feedback response indicating a feedback signal required to eliminate the difference determined to exist between the extracted parameter and the desired parameter. In an embodiment, the feedback response includes magnitude and sign (e.g., phase) of the feedback signal, which when applied to the excitation signal will compensate for changes in the extracted parameter of the transducer 610, to match or to more closely approximate the desired parameter.

The signal generator 650 then generates the feedback signal, based on the feedback response provided by the feedback circuit 640. For example, the signal generator 650 includes a DAC, which converts the digital feedback response from the feedback circuit 640 to an analog feedback signal, such as a DC voltage. In an embodiment, the feedback signal is filtered by a filter (not shown), for example, to reduce unwanted oscillatory behavior or to further enhance the transient nature of the feedback control system. Also, in an embodiment, the transducer device 600 may also include driver 660, for converting the feedback signal to useful form prior to being applied to the excitation signal 612 via adder 619. For example, the driver 660 may be an amplifier, which amplifies the DC voltage from the signal generator 650 to provide a DC bias voltage of desired magnitude.

The DC bias voltage (or other type feedback signal) is then applied to the excitation signal 612 in order to change its center frequency, which causes the transducer 610 to operate at the desired frequency, e.g., provided by specification, without altering the resonant frequency of the transducer 610, as discussed above with respect to FIGS. 1-5. The feedback signal may be applied in a positive (regenerative) or a negative (degenerative) manner.

Figure 7:
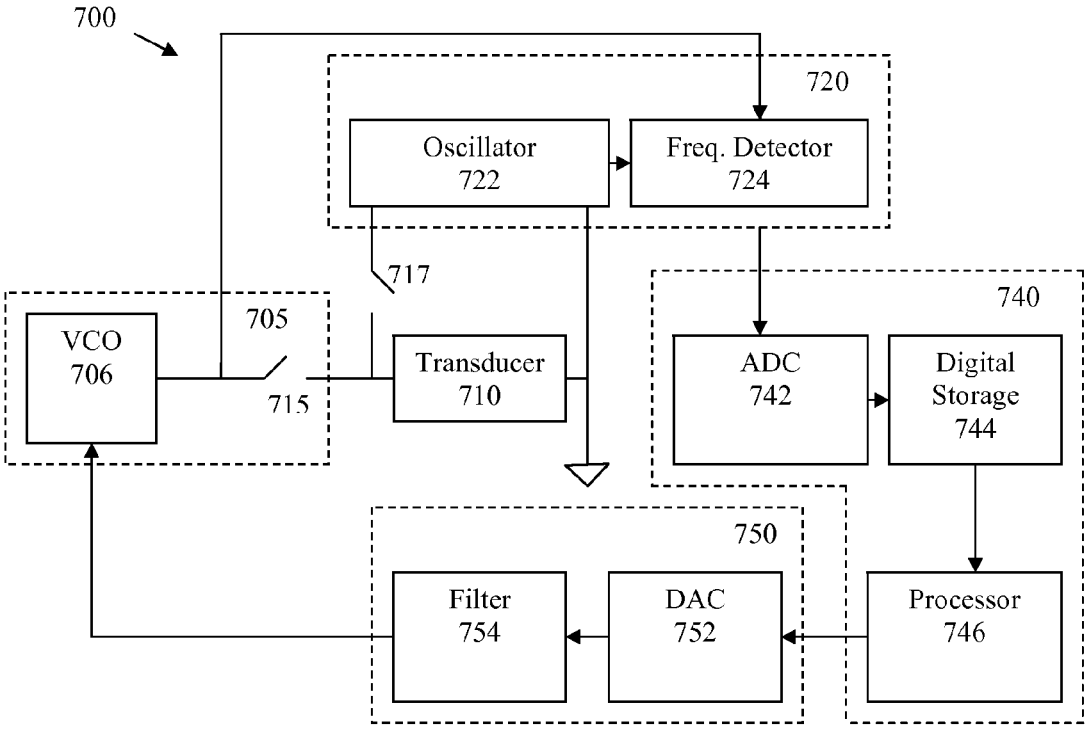
FIG. 7 is a functional block diagram of a transducer device, according to a representative embodiment.

FIG. 7 is a functional block diagram of a transducer device, according to a representative embodiment.

Referring to FIG. 7, transducer device 700 is an example of a configuration in which a feedback signal adjusts an excitation signal to compensate for a transducer parameter, as described generally with reference to FIG. 6. In particular, the representative transducer device 700 includes a feedback loop that adjusts a frequency and/or phase of the excitation signal, so that the excitation signal is coincident with the measured resonant frequency of the transducer 710. Transmitted acoustic power and acoustic receive sensitivity is thus maximized at the resonance of the transducer 710. The adjustments to the excitation signal compensate for changes that may occur in the resonant frequency of the transducer 710 and ensure adequate signal strength in the system. For example, the resonant frequency may change with aging of the transducer 710, temperature, humidity and other environmental factors. The transducer device 700 further includes parameter extractor 720, combined comparing/feedback circuit 740 and signal generator 750. It is understood that the transducer device 700 and/or the signal generator 750 may include a driver (not shown), as discussed above with respect to driver 660 in FIG. 6, as needed.

In the depicted embodiment, the parameter extractor 720 includes oscillator 722 and frequency detector 724 in order to determine the resonant frequency of the transducer 710. It is understood that in alternative embodiments, parameters other than resonant frequency of the transducer 710, such as acoustic receive sensitivity, acoustic transmit output power and relative bandwidth, may be monitored and adjusted, as needed, to alter performance of the transducer 710, without departing from the scope of the disclosure.

The transducer 710 is selectively connected to the oscillator 722 through operation of switch 717, in order to periodically extract (or measure) the resonant frequency of the transducer 710. In an alternative embodiment, the transducer 710 is always connected to the oscillator 722 for continuous parameter extraction. The frequency detector 724 connected to an output of the oscillator 722 determines the resonant frequency of the transducer 710 whenever the transducer 710 is connected to the oscillator 722.

The comparing/feedback circuit 740 receives the extracted resonant frequency, as determined by the frequency detector 724. The comparing/feedback circuit 740 includes analog-to-digital converter (ADC) 742, digital storage 744 and processor 746. The ADC 742 coverts the extracted resonant frequency to digital data, which is stored in the digital storage 744. In various embodiments, the digital storage 744 may be part of the comparing/feedback circuit 740, or the digital storage 744 may be a memory separate from the comparing/feedback circuit 740 and/or the transducer device 700. For example, the digital storage 744 may be implemented as RAM, buffers, latches or any other type or combination of memory devices. Also, the digital storage 744 may store additional information, such as previously extracted resonant frequencies, temperature, operation time, receive sensitivity, transmit output power, bandwidth and other parameters. Also, in an alternative embodiment, the parameter extractor 720 may include a digital counter, as opposed to the frequency detector 724, as discussed above with respect to FIG. 2, in which case ADC 742 would not be needed.

The processor 746 receives the resonant frequency data from the digital storage 744 (or directly from ADC 742), and determines a correction voltage using a feedback algorithm. The data stored in digital storage 744 may also be sent to a system controller (not shown), which reports current operating parameters to other system functions or the end user, e.g., for diagnostic or reporting purposes. The correction voltage may be a DC bias voltage, which is provided to voltage control oscillator (VCO) 706 of transmit circuit 705. The VCO 706 generates excitation signal at a frequency based on the DC bias voltage to vary the transmit fundamental frequency, and supplies the excitation signal to the transducer 710 via pulse gating switch 715 to compensate for changes in the resonant frequency.

More particularly, the processor 746 is configured to compare the resonant frequency data of the transducer 710 and the frequency of the excitation signal. Based on the comparison, the processor 746 determines the difference and calculates the amount by which the excitation signal must be changed in order to compensate for shifts in transducer 710 resonant frequency. For example, assuming a simple one-to-one correspondence for purposes of discussion, if the processor 746 determines that the extracted resonant frequency is 2 kHz less than the excitation signal's frequency, it concludes that the frequency of the excitation signal must be decreased by 2 kHz in order for the transducer 710 to output signals at a suitable power level. Accordingly, the feedback loop of the transducer device 700, including the frequency detector 724, the processor 746 and the VCO 706, effectively operates as a phase-locked loop (PLL) circuit.

The processor 746 may be a software-controlled microprocessor, hard-wired logic circuits, or a combination thereof, configured to execute one or more software algorithms, as discussed above with respect to processor 446, including the operating parameter feedback control process of the embodiments described herein. In an embodiment, the comparing/feedback circuit 740 may include a look-up table (not shown) that relates correction voltages and frequencies. The comparing/feedback circuit 740 is thus able to determine the correction voltage to be applied to the VCO 706 in order to generate excitation signal at a frequency compensating for resonant frequency changes of the transducer 710.

In various embodiments, the functionality of the comparing/feedback circuit 740 and/or the processor 746 may be implemented in various forms without departing from the scope of the disclosure. For example, the transducer device 700 may incorporate an FPGA, a custom ASIC, or a microcontroller, for example, to perform all or part of this functionality.

Figure 8:
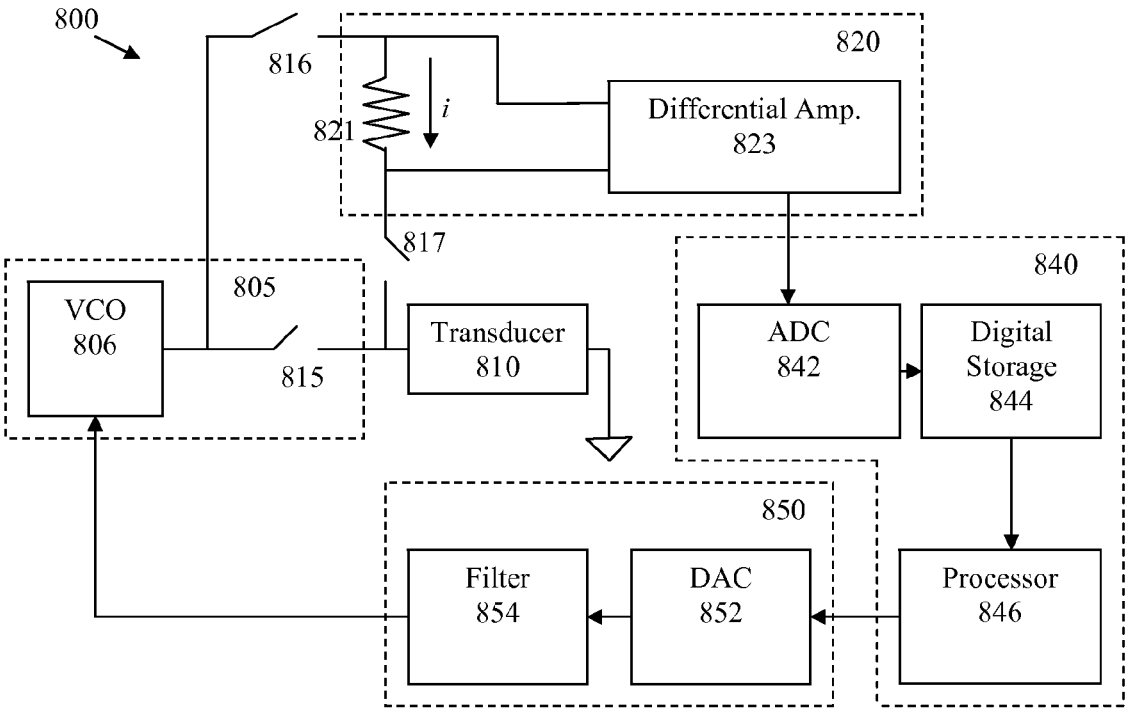
FIG. 8 is a functional block diagram of a transducer device, according to a representative embodiment.

FIG. 8 is a functional block diagram of a transducer device, according to a representative embodiment, in which an impedance method is used for resonant frequency determination.

Referring to FIG. 8, transducer device 800 is an example of a configuration in which a feedback signal adjusts an excitation signal to compensate for a transducer parameter, as described generally with reference to FIG. 6. In particular, the representative transducer device 800 includes a feedback loop that adjusts a frequency and/or phase of the excitation signal, so that the excitation signal is coincident with the measured resonant frequency of the transducer 810. In other words, the adjustments to the excitation signal compensate for changes that may occur in the resonant frequency of the transducer 810. This ensures adequate signal strength in the system. The transducer device 800 further includes parameter extractor 820, comparing/feedback circuit 840, comparing/feedback circuit 840 and signal generator 850. It is understood that the transducer device 800 and/or the signal generator 850 may include a driver (not shown), as discussed above with respect to driver 660 in FIG. 6, as needed.

In the depicted embodiment, the parameter extractor 820 includes resistor 821 and differential amplifier 823 (e.g., a preamplifier) in order to determine the resonant frequency of the transducer 810. The resistor 821 is selectively connected to the transducer 810 and the VCO 806 of transmit circuit 805 through operation of impedance mode switches 816 and 817. At the same time, the transducer 810 may be disconnected from the VCO 806 through operation of pulse gating switch 815. Accordingly, the impedance of the transducer 810 is periodically sampled by applying a frequency-varying sinusoidal voltage from the VCO 806 (e.g., a frequency sweep)

and monitoring current flow i into the transducer 810. The differential amplifier 823 detects the sampled impedance, which is output to the comparing/feedback circuit 840.

Figure 9:
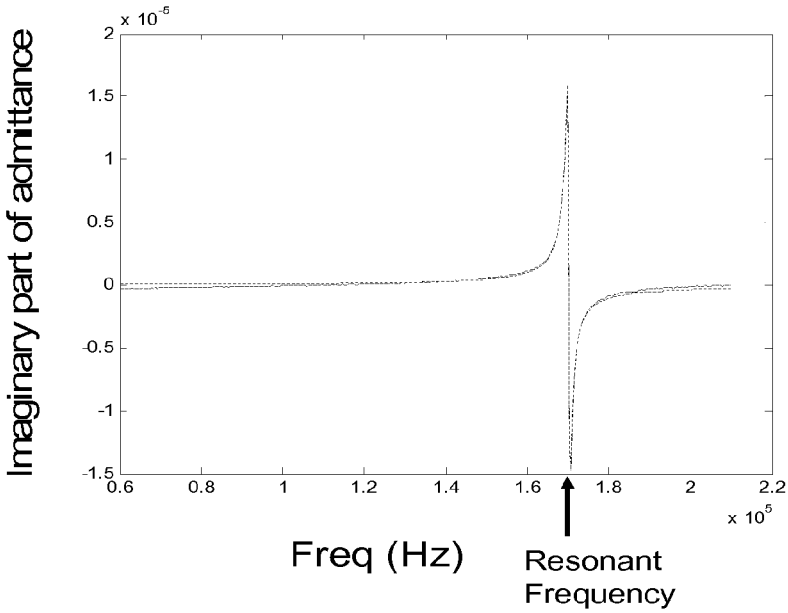
FIG. 9 is a graph showing a representative relationship between admittance and resonant frequency of a transducer device, according to a representative embodiment.

The comparing/feedback circuit 840 includes ADC 842 and digital storage 844. The ADC 842 coverts the sampled impedance to digital data, which is stored in the digital storage 844. In various embodiments, the digital storage 844 may be part of the comparing/feedback circuit 840, or the digital storage 844 may be a memory separate from the comparing/feedback circuit 840 and/or the transducer device 800. For example, the digital storage 844 may be implemented as RAM, buffers, latches or any other type or combination of memory devices. Also, the digital storage 844 may store additional information, such as previously extracted impedances, temperature, operation time, receive sensitivity, transmit output power, bandwidth and other parameters. The data stored in the digital storage 844 may be sent to a system controller (not shown), which reports current operating parameters to other system functions or the end user, e.g., for diagnostic or reporting purposes. The comparing/feedback circuit 840 includes a processor 846, configured to determine the corresponding resonant frequency of the transducer 810 based on the sampled impedance data, as well as a correction voltage to be provided to VCO 806. The processor 846 receives the sampled impedance data from the digital storage 844 (or directly from ADC 842). In order to determine the resonant frequency based on the sampled impedance data, the processor 846 effectively plots the relationship between frequencies (from the frequency sweep) and impedance (or admittance) for the transducer 810. For example, FIG. 9 is a graph of a representative plot between frequencies (e.g., in Hz) and imaginary part of admittance (e.g., in 1/ohms) for the transducer 810. In the example, the processor 846 finds a resonant frequency of 160 kHz as a function of the admittance data, as depicted by the graph.

The processor 846 is configured to compare the resonant frequency data of the transducer 810 and the frequency of the excitation signal. Based on the comparison, the processor 846 determines the difference and calculates the amount by which the excitation signal must be changed in order to compensate for shifts in transducer 810 resonant frequency. Based on the comparison, the processor 846 determines the difference and calculates the amount by which the excitation signal must be changed in order to compensate for this difference, as discussed above with respect to processor 746 of FIG. 7. The comparing/feedback circuit 840 is thus able to determine the correction voltage to be applied to the VCO 806 in order to generate excitation signal compensating for resonant frequency changes of the transducer 810.

The processor 846 may be a software-controlled microprocessor, hard-wired logic circuits, or a combination thereof, configured to execute one or more software algorithms, as discussed above with respect to processor 446, including the operating parameter feedback control process of the embodiments described herein. In an embodiment, the comparing/feedback circuit 840 may include a look-up table (not shown) that relates correction voltages and frequencies.

In various embodiments, the functionality of the comparing/feedback circuit 840 and/or the processor 846 may be implemented in various forms without departing from the scope of the disclosure. For example, the transducer device 800 may incorporate an FPGA, a custom ASIC, or a microcontroller, for example, to perform all or part of this functionality.

Figure 10:
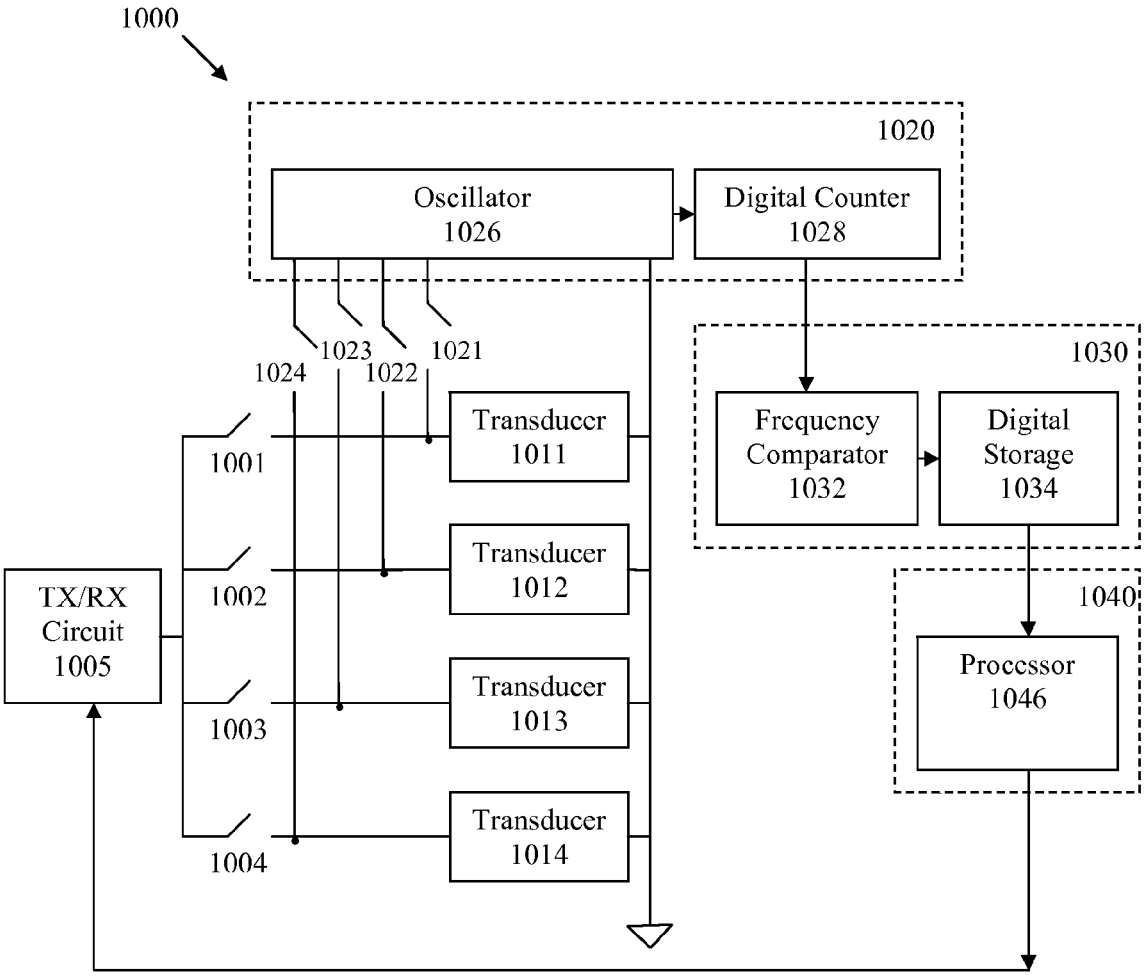
FIG. 10 is a functional block diagram of a transducer device, according to a representative embodiment.

FIG. 10 is a functional block diagram of a transducer device, according to a representative embodiment, in which a desired resonant frequency is obtained by switching among multiple transducers in a transducer array.

Referring to FIG. 10, transducer device 1000 is an example of a configuration in which a feedback signal is used to select from among multiple transducers 1011, 1012, 1013 and 1014 having different resonant frequencies, respectively, to obtain a desired resonant frequency. Unlike the embodiments of FIGS. 1 and 6, neither the performance parameters of the individual transducers 1011-1014 nor the excitation signal input to the transducers 1011-1014 are changed as a result of the feedback signal. In particular, the representative transducer device 1000 includes a feedback loop that adjusts the overall resonant frequency of the transducer device 1000, as well as bandwidth, e.g., to meet a predetermined quality factor.

As stated above, the transducer device 1000 includes an array of transducers having different resonant frequencies, indicated by representative transducers 1011-1014. The transducers 1011-1014 are selectively connected to transmit/receive circuit 1005 through operation of switches 1001-1004, respectively, in order to receive the excitation signal in transmit or receive modes. The transducers 1011-1014 are selectively connected to oscillator 1026 of parameter extractor 1020 through operation of switches 1021-1024, respectively, in order for respective resonant frequencies to be measured. The operations of switches 1001-1004 and 1021-1024 are controlled by feedback circuit 1040, discussed below. The transducer device 1000 further includes comparing circuit 1030.

More particularly, the transducers 1011-1014 are fabricated with slightly offset nominal resonant frequencies. For example, transducers 1011, 1012, 1013 and 1014 may have resonant frequencies of 9.6 kHz, 9.9 kHz, 10.2 kHz and 10.5 kHz, respectively. Therefore, if the transducer device 1000 requires a resonant frequency of 9.9 kHz, for example, transducer 1012 may be connected to the transmit/receive circuit 1005 for operation. The resonant frequency of the transducer 1012 is periodically checked by selectively connecting the transducer 1012 to the oscillator 1026 (e.g., while temporarily disconnecting the transducer 1012 from the transmit/receive circuit 1005).

The resonant frequency may be extracted (measured), identified and/or compared to desired resonant frequency by the parameter extractor 1020 and the comparing circuit 1030 according to any of the representative configurations discussed above. However, for purposes of discussion, the parameter extractor 1020 and the comparing circuit 1030 are the same as discussed above with respect to FIGS. 2, 4 and 5.

For example, the parameter extractor 1020 includes oscillator 1026 and digital counter 1028 in order to determine the resonant frequency of any transducer (e.g., transducer 1012, for purposes of discussion) connected to the parameter extractor 1020. The digital counter 1028 determines the resonant frequency of the transducer 1012, and provides data identifying the extracted resonant frequency to the comparing circuit 1030. The comparing circuit 1030 includes frequency comparator 1032 and digital storage 1034, which function as discussed above with respect to frequency comparator 232 and digital counter 224 of FIG. 2, for example. Based on the comparison, the frequency comparator 1032 outputs a difference signal, which may be a digital code word, for example, which is stored in digital storage 1034.

The feedback circuit 1040 includes the processor 1046, which may be a software-controlled microprocessor, hard-wired logic circuits, or a combination thereof, configured to execute one or more software algorithms, as discussed above with respect to processor 446, including the operating parameter feedback control process of the embodiments described herein. The processor 1046 receives the digital code word from the digital storage 1034 (or directly from the frequency comparator 1032). When the digital code word indicates no difference (or an acceptable difference) between the extracted resonant frequency and the desired resonant frequency, the processor 1046 determines that the configuration of the transmit/receive circuit 1005 and the transducer 1012 remains the same. That is, the transducer 1012 is connected to the transmit/receive circuit 1005 through operation of the switch 1002. However, when the digital code word indicates an unacceptable difference between the extracted resonant frequency and the desired resonant frequency, the processor 1046 determines which transducer of the remaining transducers (e.g., transducers 1011, 1013 and 1014) will best provide the desired resonant frequency.

For example, if the extracted resonant frequency of transducer 1012 is 9.7 kHz instead of 9.9 kHz, the processor 1046 will select transducer 1013, which has a nominal resonant frequency of 10.2 kHz, to replace transducer 1012. Thus, the processor 1046 will instruct switch 1002 to remain open and switch 1003 to close, connecting transducer 1013 to the transmit/receive circuit 1005. Of course, the resonant frequency of transducer 1013 will be extracted and compared with the desired resonant frequency (e.g., by connecting transducer 1013 to the oscillator 1026 through switch 1023), to assure that the extracted resonant frequency is indeed the best match for the desired resonant frequency. In an embodiment, the resonant frequencies of all the transducers 1011-1014 are periodically checked through parameter extractor 1020 and comparing circuit 1030, so that the feedback circuit 1040 is able to maintain a current list of actual resonant frequencies. Therefore, the best choice for replacing a transducer (e.g., transducer 1012) may be made with updated resonant frequencies, since factors such as age, temperature, humidity and the like are likely to affect all transducers 1011-1014 in the same or similar manner.

In various embodiments, the functionality of the feedback circuit 1040 and/or the processor 1046 may be implemented in various forms without departing from the scope of the disclosure. For example, the transducer device 1000 may incorporate an FPGA, a custom ASIC, or a microcontroller, for example, to perform all or part of this functionality.

Accordingly, transducers 1010-1014 may be selectively connected to the transmit/receive circuit 1005 to maintain the transducer device 1000 at or near the desired resonant frequency. The resonant frequencies of transducers 1010-1014 are also periodically extracted and compared to the desired resonant frequency to assure that the transducer having the closest matching resonant frequency is selected.

Figure 11:
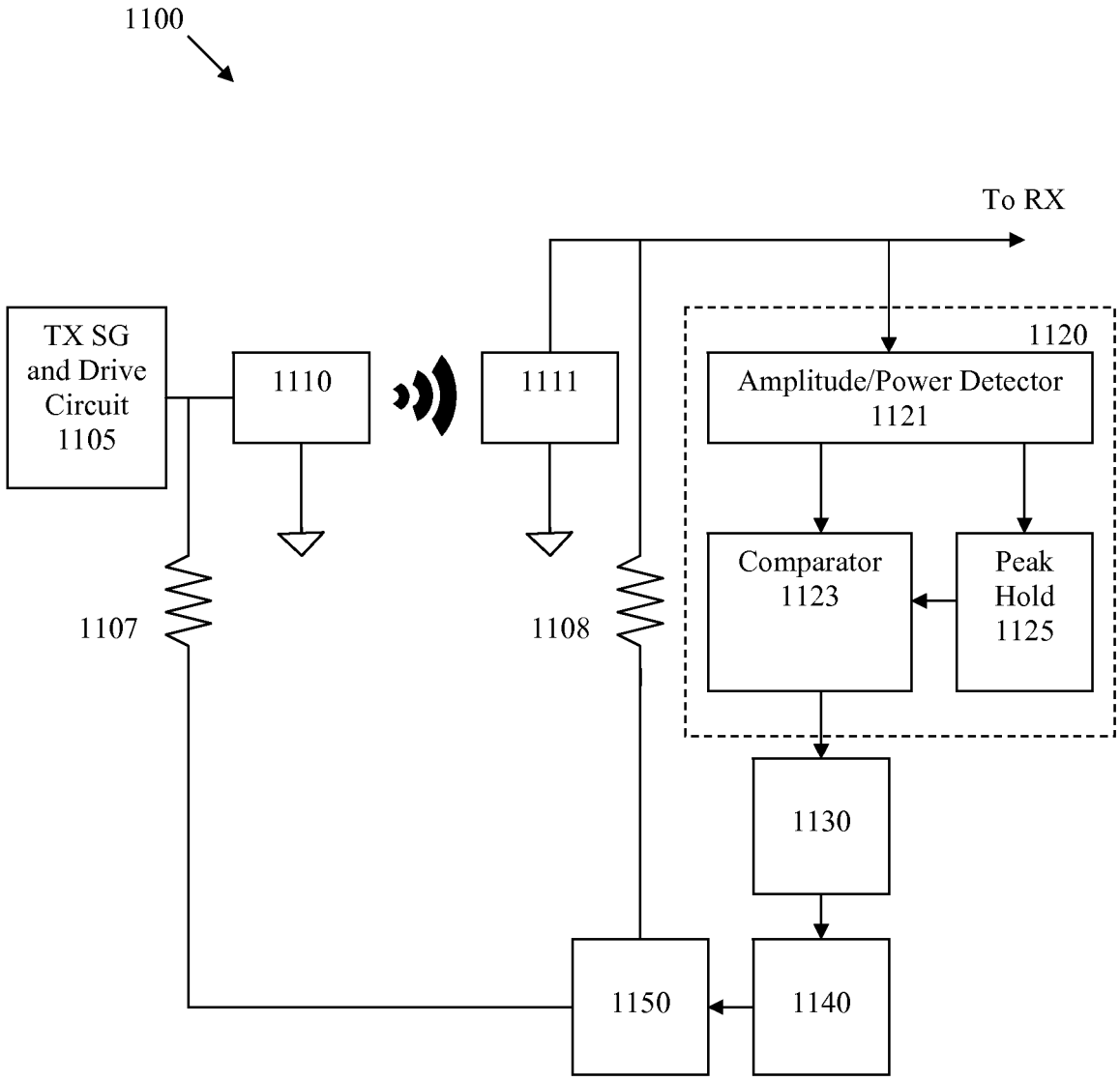
FIG. 11 is a functional block diagram of a transducer device, according to a representative embodiment.
Figure 12:
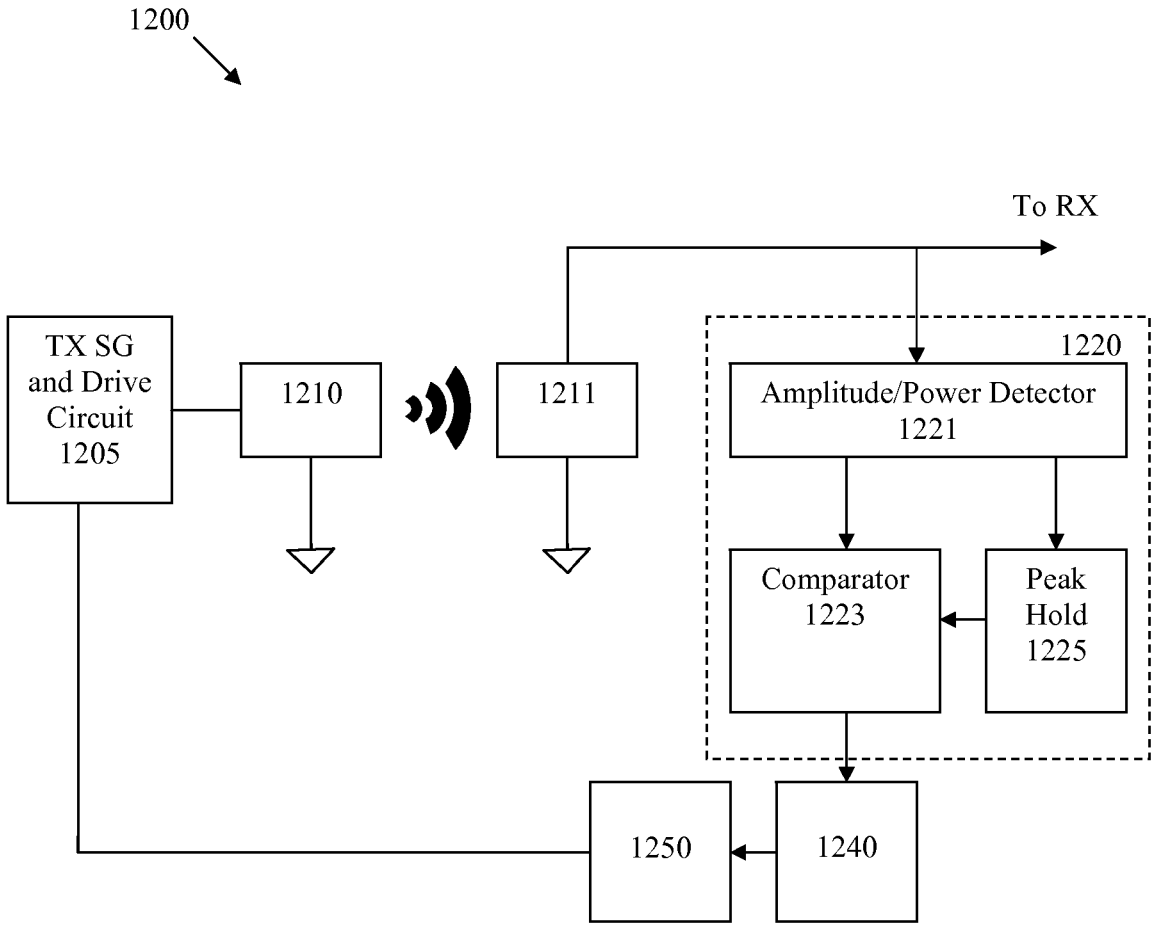
FIG. 12 is a functional block diagram of a transducer device, according to a representative embodiment.

FIGS. 11 and 12 are functional block diagrams of transducer devices, according to representative embodiments, in which a resonant frequency is determined as a function of acoustic signals received by a receive transducer from a transmit transducer. More particularly, FIG. 11 depicts a transducer device, in which feedback directly adjusts an operating parameter of the transmit transducer (and receive transducer), such as resonant frequency, as generally depicted in FIG. 1, while FIG. 12 depicts a transducer device in which feedback adjusts an excitation signal received by the transmit transducer to compensate for shifts in an operating parameter, such as resonant frequency, as generally depicted in FIG. 6.

Referring to FIG. 11, transducer device 1100 includes transmit and receive sides. The transmit side includes transmit signal generation and drive circuit 1105 and transmit transducer 1110. The receive side includes receive transducer 1111, parameter extractor 1120, comparing circuit 1130, feedback circuit 1140 and signal generator 1150.

The transmit transducer 1110 receives a constant frequency electric input signal from the transmit signal generation and drive circuit 1105, and accordingly outputs a constant frequency acoustic output signal based on the resonant frequency of the transmit transducer 1110. The receive transducer 1111 receives the acoustic output signal, converts it to an electric signal, which may then be amplified by a preamplifier (not shown) and provided to the parameter extractor 1120. In the depicted embodiment, the parameter extractor 1120 includes amplitude/power detector 1121, comparator 1123 and peak hold circuit 1125 for determining resonant frequency, which effectively is a combined resonant frequency of the transmit transducer 1110 and the receive transducer 1111.

During a calibration operation, the signal generation and drive circuit 1105 applies a frequency sweep to the input electric signal, which is converted to an acoustic signal by the transmit transducer 1110 and converted back to an electric signal by the receive transducer 1111. The amplitude/power detector 1121 detects amplitude at each frequency of the electric signal output by the receive transducer 1111. Each peak amplitude of the output signal is held in peak hold circuit 1125 and compared to subsequent detected amplitudes by comparator 1123 until the peak amplitude among all detected amplitudes is identified. The frequency corresponding to the peak amplitude is determined to be the resonant frequency, as extracted (or measured) by the parameter extractor 1120.

The extracted resonant frequency is compared to a desired frequency by comparing circuit 1130, and the feedback circuit 1140 determines a DC bias voltage to be applied by the signal generator/driver 1150 to both the transmit transducer 1110 and the receive transducer 1111 via resistors 1107 and 1108, respectively. The functionality of each of the comparing circuit 1130, the feedback circuit 1140 and the signal generator 1150 may be substantially the same as the comparing circuit 230, the feedback circuit 240 and the signal generator 250 discussed above with respect to FIG. 2, for example, and therefore will not be repeated. Further, it is understood that the transducer device 1100 and/or the signal generator 1150 may include a driver (not shown), as discussed above with respect to driver 160 in FIG. 1, as needed.

Similarly, referring to FIG. 12, transducer device 1200 includes transmit and receive sides. The transmit side includes transmit signal generation and drive circuit 1205 and transmit transducer 1210. The receive side includes receive transducer 1211, parameter extractor 1220, comparing/feedback circuit 1240 and signal generator 1250.

The transmit transducer 1210 receives a constant frequency electric input signal from the transmit signal generation and drive circuit 1205, and accordingly outputs a constant frequency acoustic output signal based on the resonant frequency of the transmit transducer 1210. The receive transducer 1211 receives the acoustic output signal, converts it to an electric signal, which may then be amplified by a preamplifier (not shown) and provided to the parameter extractor 1220. In the depicted embodiment, the parameter extractor 1220 includes amplitude/power detector 1221, comparator 1223 and peak hold circuit 1225 for determining resonant frequency, which effectively is a combined resonant frequency of the transmit transducer 1210 and the receive transducer 1211.

During a calibration operation, the signal generation and drive circuit 1205 applies a frequency sweep to the input electric signal, which is converted to an acoustic signal by the transmit transducer 1210 and converted back to an electric signal by the receive transducer 1211. The amplitude/power detector 1221 detects amplitude at each frequency of the electric signal output by the receive transducer 1211. Each peak amplitude of the output signal is held in peak hold circuit 1225 and compared to subsequent detected amplitudes by comparator 1223 until the peak amplitude among all detected amplitudes is identified. The frequency corresponding to the peak amplitude is determined to be the resonant frequency, as extracted (or measured) by the parameter extractor 1220.

The comparing/feedback circuit 1240 compares the extracted resonant frequency with the frequency of the excitation signal (e.g., as provided by the transmit signal generation and drive circuit 1205 when not operating in the calibration operation). Based on the comparison, the comparing/feedback circuit 1240 determines the difference and calculates the amount by which the excitation signal must be changed in order to compensate for shifts in transmit transducer 1210 resonant frequency (as well as for shifts in the receive transducer 1211 resonant frequency). The functionality of each of the comparator/feedback circuit 1240 and the signal generator 1250 may be substantially the same as the comparing/feedback circuit 740 and the signal generator 750 discussed above with respect to FIG. 7, for example, and therefore will not be repeated. Further, it is understood that the transducer device 1200 and/or the signal generator 1250 may include a driver (not shown), as discussed above with respect to driver 660 in FIG. 6, as needed.

The various components, materials, structures and parameters are included by way of illustration and example only and not in any limiting sense. In view of this disclosure, those skilled in the art can implement the present teachings in determining their own applications and needed components, materials, structures and equipment to implement these applications, while remaining within the scope of the appended claims.

The invention claimed is:

1. A transducer device, comprising:

an acoustic transducer configured to receive an excitation signal;

a parameter extractor configured to extract an operating parameter from the acoustic transducer responding to the excitation signal; and a feedback circuit configured to generate a correction signal based on a difference between the extracted operating parameter and a corresponding reference parameter, the correction signal being applied to adjust the operating parameter of the acoustic transducer.

2. The transducer device of claim 1, wherein the operating parameter comprises a resonant frequency of the acoustic transducer, and the reference parameter comprises a predetermined resonant frequency.

3. The transducer device of claim 2, wherein the parameter extractor comprises:

an oscillator selectively connected to the acoustic transducer and configured to output the resonant frequency of the acoustic transducer; and a digital counter configured to determine the resonant frequency.

4. The transducer device of claim 3, further comprising:

a comparing circuit configured to compare the resonant frequency output from the digital counter with the predetermined resonant frequency, and to generate a difference signal identifying the difference between the extracted operating parameter and the reference parameter.

5. The transducer device of claim 2, further comprising:

a receive acoustic transducer configured to receive an acoustic signal transmitted from the acoustic transducer and to output a corresponding electric signal, wherein the parameter extractor comprises:

an amplitude/power detector configured to detect amplitudes of the output signal in response to a plurality of frequencies; and a comparator configured to determine a peak amplitude of the detected amplitudes, wherein a frequency corresponding to the peak amplitude substantially comprises the resonant frequency.

6. The transducer device of claim 2, wherein the correction signal generated by the feedback circuit identifies a DC bias voltage to be applied to the acoustic transducer, the DC bias voltage changing the resonant frequency of the acoustic transducer to match the predetermined resonant frequency.

7. The transducer device of claim 6, further comprising:

a digital-to-analog converter configured to convert the correction signal to the DC bias voltage to be applied to the acoustic transducer.

8. The transducer device of claim 2, further comprising:

a heating element configured to heat the acoustic transducer to a selected temperature, wherein operation of the acoustic transducer at the selected temperature causes the resonant frequency of the acoustic transducer to match the predetermined resonant frequency.

9. The transducer device of claim 8, wherein the correction signal generated by the feedback circuit identifies a voltage to be applied to the heating element, the voltage corresponding to an amount of heat output by the heating element to heat the acoustic transducer to the selected temperature.

10. The transducer device of claim 1, wherein the operating parameter comprises one of acoustic receive sensitivity, acoustic transmit output power and relative bandwidth.

11. The transducer device of claim 1, further comprising:

an array of acoustic transducers, including the acoustic transducer, selectively connectable to the parameter extractor, which extracts corresponding operating parameters from the acoustic transducers, wherein the correction signal generated by the feedback circuit identifies one of the acoustic transducers to be an operating acoustic transducer based on a difference between the extracted operating parameter of each of the acoustic transducers and the reference parameter.

12. The transducer device of claim 11, wherein the identified operating acoustic transducer is connected to a transmit/receive circuit to receive an excitation signal.

13. A transducer device, comprising:

an acoustic transducer configured to receive an excitation signal;

a parameter extractor configured to extract an operating parameter from the acoustic transducer responding to the excitation signal; and a feedback circuit configured to generate a correction signal based on a difference between the extracted operating parameter and a reference parameter, the correction signal being used to adjust the excitation signal received by the acoustic transducer to compensate for the difference between the extracted operating parameter and the reference parameter.

14. The transducer device of claim 13, further comprising:

a transmit circuit configured to provide the excitation signal to the acoustic transducer, the transmit circuit comprising a voltage controlled oscillator (VCO) for controlling a frequency of the excitation signal.

15. The transducer device of claim 14, wherein the operating parameter comprises a resonant frequency of the acoustic transducer, and the reference parameter comprises the frequency of the excitation signal.

16. The transducer device of claim 15, wherein the parameter extractor comprises:

an oscillator selectively connected to the acoustic transducer for outputting the resonant frequency of the acoustic transducer; and a frequency detector for determining the resonant frequency.

17. The transducer device of claim 15, further comprising:

a receive acoustic transducer configured to receive an acoustic signal transmitted from the acoustic transducer and to output a corresponding electric signal, wherein the parameter extractor comprises:

an amplitude/power detector configured to detect amplitudes of the output signal in response to a plurality of frequencies provided by the transmit circuit; and a comparator configured to determine a peak amplitude of the detected amplitudes, wherein a frequency corresponding to the peak amplitude substantially comprises the resonant frequency.

18. The transducer device of claim 15, wherein the parameter extractor comprises:

a resistor selectively connected to the acoustic transducer and configured to periodically receive a frequency-varying sinusoidal voltage; and a differential amplifier configured to monitor current flow through the resistor while receiving the a frequency-varying sinusoidal voltage, and to detect impedance of the acoustic transducer based on the monitored current flow, wherein the feedback circuit determines the resonant frequency of the acoustic transducer as a function of the impedance.

19. A transducer device, comprising:

a first acoustic transducer having a first operating parameter, the first acoustic transducer being connected to a transmit/receive circuit;

a second acoustic transducer having a second operating parameter corresponding to the first operating parameter;

a parameter extractor configured to extract the second operating parameter from the second acoustic transducer;

a heating element configured to heat the first and second acoustic transducers to a selected temperature; and a feedback circuit configured to generate a correction signal based on a difference between the extracted second operating parameter and a corresponding reference parameter, the correction signal being used to adjust an amount of heat generated by the heating element to heat the first acoustic transducer to the selected temperature, wherein operation of the first acoustic transducer at the selected temperature causes the first operation parameter to match the reference parameter.

20. The transducer device of claim 19, wherein the heating element comprises a resistive heater, and the correction signal identifies a voltage to be applied to the resistive heater.

* * * * *